US007921470B2

(12) United States Patent
Doran

(10) Patent No.: US 7,921,470 B2
(45) Date of Patent: Apr. 12, 2011

(54) SLEEVE HOLDER

(75) Inventor: Barbara Doran, West Chester, PA (US)

(73) Assignee: Kuffco, LLC, West Chester, PA (US)

( * ) Notice: Subject to any disclaimer, the term of this patent is extended or adjusted under 35 U.S.C. 154(b) by 47 days.

(21) Appl. No.: 12/456,124

(22) Filed: Jun. 11, 2009

(65) Prior Publication Data

US 2009/0313739 A1 Dec. 24, 2009

Related U.S. Application Data

(60) Provisional application No. 61/132,343, filed on Jun. 18, 2008.

(51) Int. Cl.
*A41D 27/12* (2006.01)

(52) U.S. Cl. ..... 2/59

(58) Field of Classification Search ..... 2/46, 59, 2/170, 16, 124, 60–62, 47, 17, 22, 52, 126, 2/211, 221, 88, 242, 244; 132/273, 274; 602/62, 63, 64, 65

See application file for complete search history.

(56) References Cited

U.S. PATENT DOCUMENTS

| | | | | | |
|---|---|---|---|---|---|
| 120,324 | A | * | 10/1871 | Reed | 2/59 |
| 148,178 | A | | 3/1874 | Chase | |
| 293,500 | A | * | 2/1884 | Northrup | 2/170 |
| 699,802 | A | * | 5/1902 | Mendelsohn | 2/170 |
| 815,998 | A | | 3/1906 | Woff | |
| 1,284,536 | A | * | 11/1918 | Yaeger | 2/59 |
| 1,407,658 | A | * | 2/1922 | Kelly | 2/170 |
| 1,596,158 | A | | 4/1926 | Dempsey | |
| 1,691,958 | A | | 11/1928 | Davant | |
| 2,042,567 | A | | 6/1936 | Trieschmann | |
| 2,326,422 | A | * | 8/1943 | Weisberger | 2/59 |
| 2,431,287 | A | * | 11/1947 | Washington | 2/239 |
| 2,638,599 | A | * | 5/1953 | Flink | 2/170 |
| 3,251,066 | A | * | 5/1966 | Takacs | 2/46 |
| 3,797,043 | A | * | 3/1974 | Brument | 2/69.5 |
| 3,837,007 | A | * | 9/1974 | Girest | 359/519 |
| 4,843,645 | A | * | 7/1989 | White | 2/59 |
| 4,893,372 | A | * | 1/1990 | Wenzel | 15/227 |
| 5,067,177 | A | | 11/1991 | Binder | |
| 5,143,762 | A | * | 9/1992 | Ho | 428/35.7 |
| 5,187,813 | A | | 2/1993 | Klein | |
| 5,263,202 | A | * | 11/1993 | Siberell | 2/336 |
| 5,542,121 | A | * | 8/1996 | Lahaussois et al. | 2/59 |
| 5,734,992 | A | | 4/1998 | Ross | |
| 5,758,671 | A | | 6/1998 | Thim | |
| 5,761,746 | A | | 6/1998 | Brown | |
| 5,918,315 | A | | 7/1999 | Trachtenberg | |
| 5,924,130 | A | | 7/1999 | Fragomeli | |
| 6,023,786 | A | | 2/2000 | Burnett | |
| 6,085,695 | A | * | 7/2000 | Miller et al. | 119/795 |
| 6,199,217 | B1 | * | 3/2001 | Mooney | 2/240 |
| 6,263,610 | B1 | * | 7/2001 | Doubts, Jr. | 43/26 |

(Continued)

*Primary Examiner* — Amy B Vanatta
(74) *Attorney, Agent, or Firm* — Eugene E. Renz, Jr.

(57) ABSTRACT

A sleeve holder for maintaining a garment sleeve in a rolled or gathered condition on the wearer's forearm above the wrist, is disclosed. The sleeve holding device comprises an elongated body of a truncated cone shape having opposite ends. The narrower end includes an elastic core located within its interior defined by a cover. The elastic core has a relaxed length and a relatively longer stretched length in response to an applied tensile force. The opposite end of the sleeve holding device is wider in circumference than the elastic core, creating a pocket where the sleeve of the garment is held.

8 Claims, 8 Drawing Sheets

U.S. PATENT DOCUMENTS

| | | | | |
|---|---|---|---|---|
| 6,298,496 | B1 * | 10/2001 | Evans | 2/239 |
| 6,421,830 | B1 * | 7/2002 | Reynolds | 2/59 |
| 6,449,772 | B1 | 9/2002 | Donner | |
| 6,775,846 | B1 | 8/2004 | Lafauci et al. | |
| 6,826,779 | B1 | 12/2004 | McKenzie | |
| 6,859,940 | B1 * | 3/2005 | Sholander | 2/69 |
| 7,073,202 | B1 | 7/2006 | Geary | |
| 7,200,870 | B1 | 4/2007 | Kolk | |
| 2002/0056467 | A1 * | 5/2002 | Srivastava | 132/273 |
| 2003/0029470 | A1 * | 2/2003 | Srivastava | 132/274 |
| 2010/0108088 | A1 * | 5/2010 | Britton et al. | 132/200 |
| 2010/0186146 | A1 * | 7/2010 | Askew | 2/209 |

* cited by examiner

SLEEVE HOLDER

CROSS REFERENCE TO RELATED APPLICATIONS

This application claims priority to the provisional patent application with Ser. No. 61/132,343 filed on Jun. 18, 2008.

FIELD OF THE INVENTION

The present invention relates generally to wearing apparel. More particularly the present invention relates to a protective device for sleeved garments, such as shirts, blouses, long sleeved dresses, sweaters and the like.

BACKGROUND

Long-sleeved garments can prove to be inconvenient and troublesome when the wearer engages in certain activities with their hands. Activities such as washing dishes and household chores, gardening, as well as arts and crafts all represent situations where the wearer's sleeved garment is prone to getting wet or soiled during the aforementioned activities. Therefore, it is desirable to provide a way for protecting garment sleeves during these activities.

SUMMARY OF THE INVENTION

Embodiments of the present invention provide a sleeve holder, having a truncated cone shape, which is placed on the forearm with the wider opening leading up the arm toward the shoulder. The smaller opening fits snuggly around the wearer's forearm holding its position while keeping the garment sleeve protected from the elements.

According to one embodiment of the present invention, there is provided a device for holding a sleeve of a garment in a rolled or gathered condition worn on the user's forearm to maintain the sleeve of the wearer's garment above the wrist. The sleeve holding device includes an elongated body of a truncated cone shape having, thereby forming a wide opening and a narrow opening on opposite ends. The narrower opening includes an elastic core located within the interior of the cover. In one embodiment, the elastic core is stitched to the interior of the cover only at the fabric ends, allowing for greater flexibility. In another embodiment, the elastic core is stitched to the interior of the cover at multiple points to preserve the truncated cone shape. The elastic core has a relaxed length and a relatively longer stretched length in response to an applied tensile force. The opposite end of the sleeve holding device is wider in circumference than the elastic core, creating a pocket where the sleeve of the garment is held.

In one embodiment, the sleeve holding device has a single stitched seam holding it together. In one embodiment, the body cover is made from a double width of fabric material having opposite side edge portions secured to each other to define a closed cross section. This double thickness adds to the durability and stability of the cover. If additional stability is desired an interfacing may be added to the inside of the sleeve holding device before stitching is initiated. In another embodiment, the body cover is comprised of latex rubber, providing improved protection from water and other liquids.

DETAILED DESCRIPTION

Figure 1:
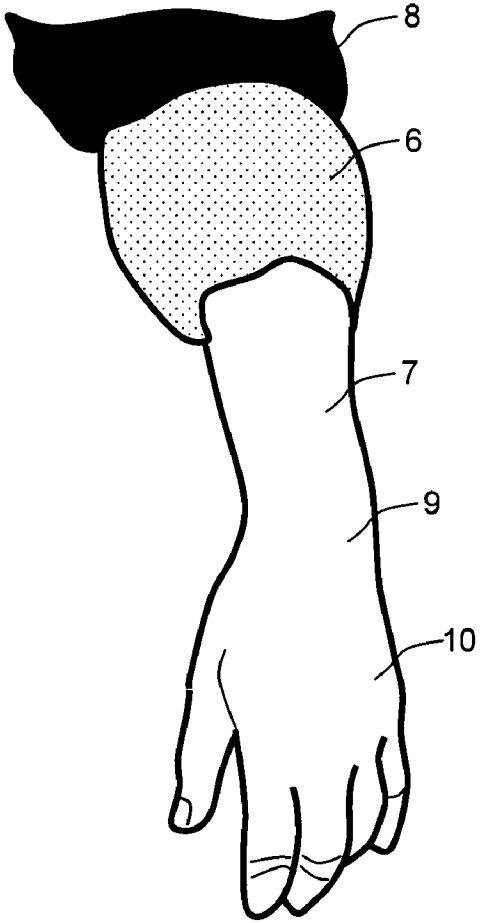
FIG. 1 is a perspective illustration showing a sleeve holder for maintaining a garment sleeve in a rolled or gathered condition on the wearer's forearm above the wrist.

Referring to the drawings where like numerals identify like elements, there is illustrated in FIG. 1 a sleeve holder 6 according to the present invention secured to the wearer's forearm 7 worn by a person. The sleeve holder 6 maintains a sleeve 8 of the sleeved garment above the wrist 9 of the wearer. The sleeved garment shown in FIG. 1 is a long-sleeved sweatshirt. It should be understood, however, that the sleeve holder 6 could be used with other types of sleeved garments, such as blouses, sweaters, and long-sleeved dresses, to name a few.

The sleeve 8 of the sleeved garment is shown in FIG. 1 in a gathered-up condition on the forearm above the wrist 9. Alternatively, the sleeve holder 6 could be used to maintain the sleeve in a rolled-up, or bunched, condition on the forearm 7 above the wrist 9. As shown, the securing of the sleeve 8 in this manner exposes the forearm 7 of the person in a similar fashion as a ¾ length sleeved shirt. This promotes freedom of movement for the person's forearm 7, desirable for people using their hands in water or other materials that could come in contact with their sleeve 8, if not protected.

Figure 1B:
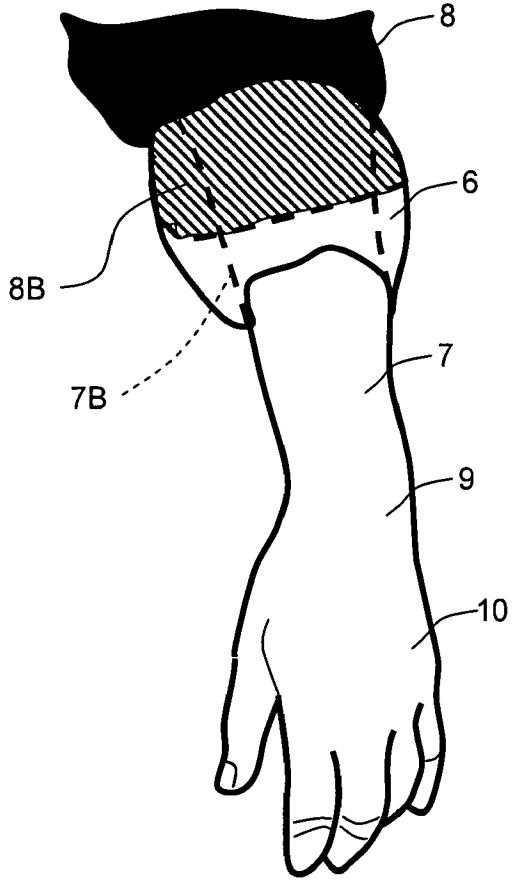
FIG. 1B is a cutaway illustration showing the sleeve holder of FIG. 1.

FIG. 1B shows the sleeve holder 6 of FIG. 1 in a cutaway view. In this view, the portion of the wearer's forearm that is covered by the sleeve holder 6 is indicated as 7B. The portion of sleeve 8 that is covered by the sleeve holder 6 is indicated as 8B. The sleeve holder 6 is essentially a truncated cone shape, having a wider end and a narrow end. The diameter of the wider end is preferably chosen to be wider than a typical wearer's forearm, such that a space between the sleeve holder 6 and the forearm 7B is formed. This space is referred to as the "pocket." Sleeve portion 8B rests in this pocket defined by the space between the sleeve holder 6 and the forearm 7B.

As will be described in greater detail, the sleeve holder 6 is adapted for removable attachment to the forearm. The use of the removable sleeve holder 6 for maintained forearm exposure, instead of removal of the sleeve, preserves the integrity of the garment for wearing of the sleeves in an unrolled condition at other times. This is desirable when the garment is worn by a hostess of a dinner party, for example.

Referring to FIGS. 2-5, the sleeve holder 6 consists of a central and continuous body portion 11. As shown in the sectional view of FIG. 4, the sleeve holder 6 comprises interior 12 enclosed by an outer cover 13. The outer cover 13 is preferably made from a fabric material such as cotton, polyester, or nylon. The fabric may be treated for water and stain resistance and/or made of a waterproof material such as latex rubber or leather. In one embodiment, the fabric is coated with a waterproof coating, such as NIKWAX, distributed by NIKWAX North America, of Seattle, Wash. To form the cover 13, a piece of fabric material is secured along longitudinally extending side edge portions 14, 15 preferably by a seam line of stitching. The end portions 16, 17 are then secured together by a seam line of stitching 22, located on the reverse side, (see FIG. 5), such that the piece of fabric defines a closed cross section in the nature of a conical tube defined by the cover 13.

Figure 2:
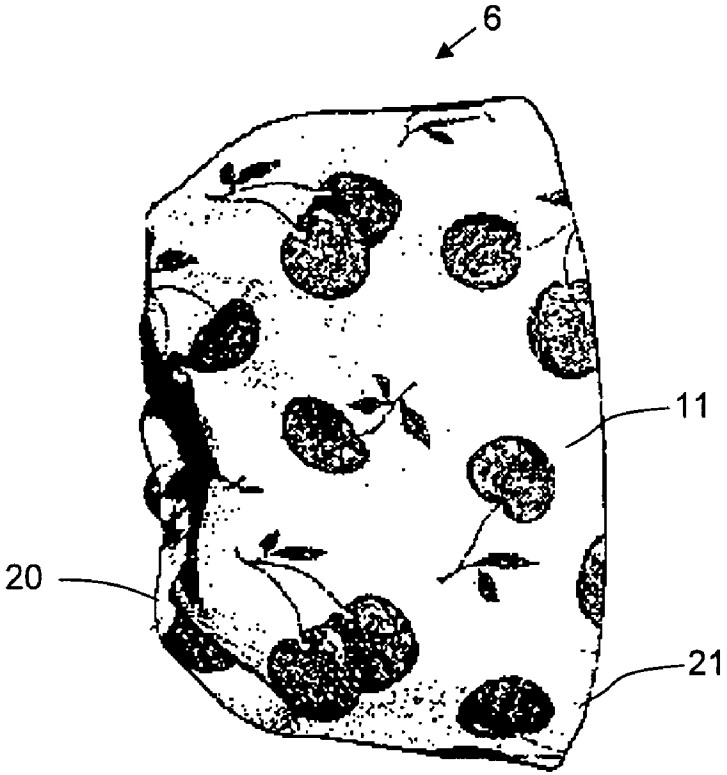
FIG. 2 is a side plan view of the sleeve holder of FIG. 1 with the opposite end portions separated from each other to show the conical shape, gathered at one end and open at the receiving end of the sleeve holder.
Figure 3:
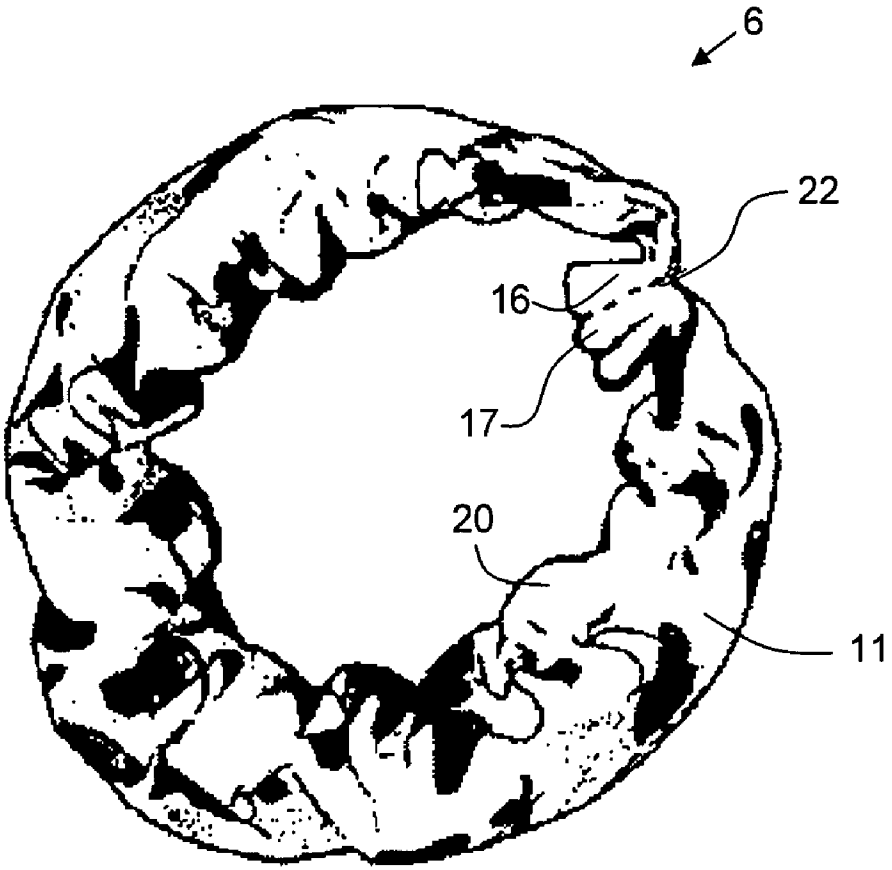
FIG. 3 is an end plan view of the sleeve holder of FIG. 2 showing the device from the gathered end.
Figure 4:
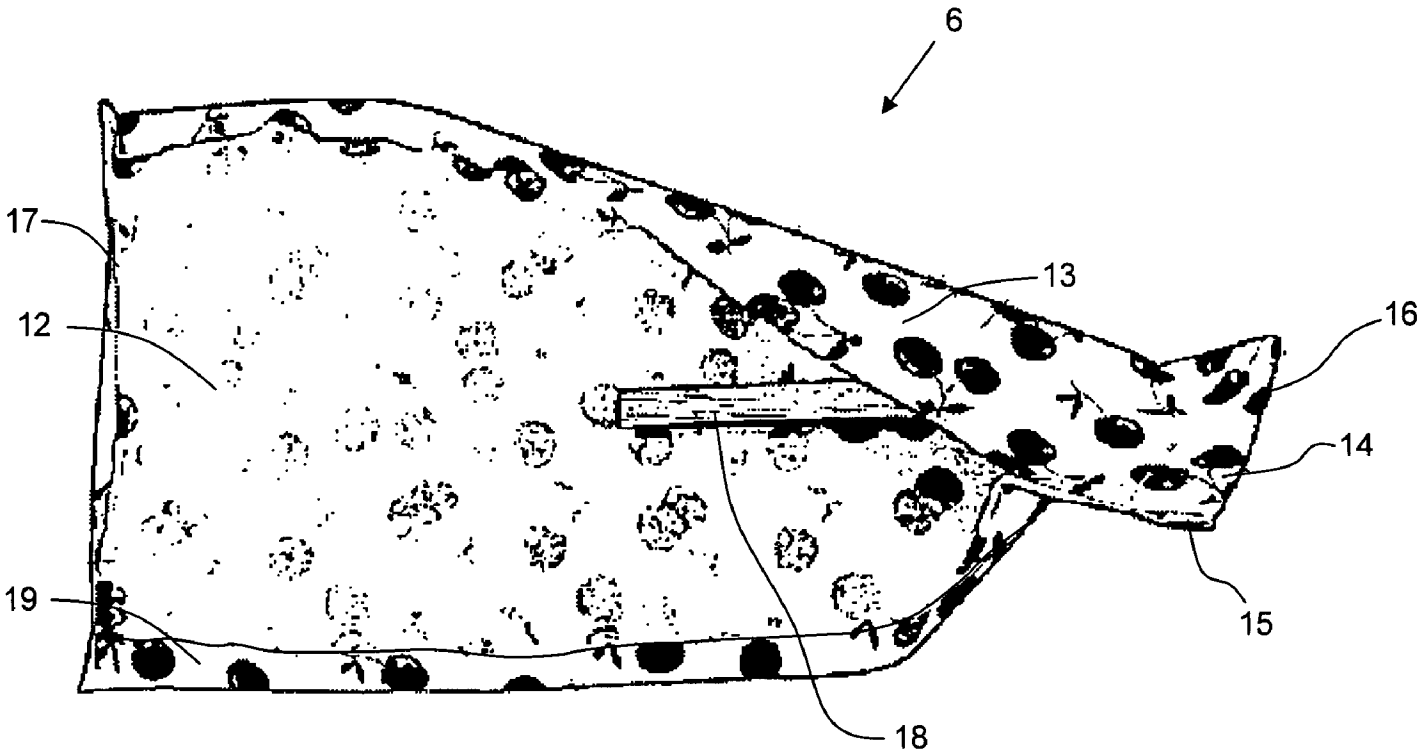
FIG. 4 is a view of a partially assembled sleeve holder.

A bias facing 19 may be added to the interior 12 of the cover 13 to help add stability to the fabric cover 13. This helps the body portion 11 maintain its shape through washing and wearing. The core 18 is made from an elastic material such that it will increase in length longitudinally from a relaxed length in response to an applied tensile load. As shown in FIGS. 2-3, the body portion 11 is defined by forming a fabric material into a conical-like shape. In one embodiment, the gathered fabric portions at narrow end 20 are formed by attaching the elastic core 18 to the cover 13 when the core 18 is held in a stretched condition. The cover 13 has a length that corresponds to a stretched length for the elastic core 18.

The core 18 is attached to the cover 13 just short of the end portions 16, 17. As a result, the return of the elastic core 18 to its relaxed length following removal of the tensile load causes compression of the cover 13 resulting in the formation of the gathered portions at narrow end 20 of body portion 11. At the wide end 21 of the body portion 11 the fabric is in a relaxed state causing it to be able to accept the extra material from the bunched, rolled or gathered sleeve 8. The extensible nature of the body 13 of sleeve holder 6 facilitates use of a given sleeve holder with differing garment types, such as long sleeved blouses, bathrobes, shirts, or sweaters.

Referring again to FIG. 1, the sleeve holder 6 is received by the sleeve 8, by placing the hand 10 through the sleeve holder 6 and onto the forearm 7 with the sleeve 8 rolled-up. The sleeve holder 6 is then brought up the forearm 7 until the appropriate amount of tension is reached to create a secured fit on the forearm 7.

Figure 5:
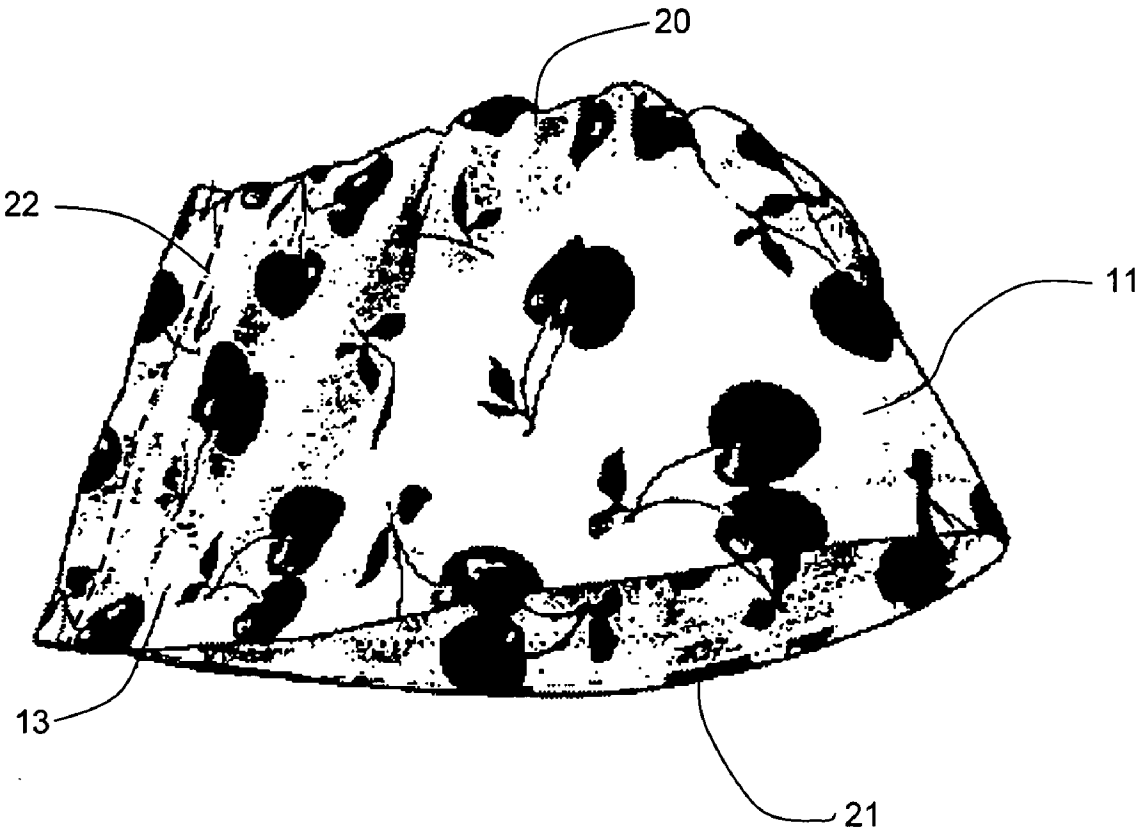
FIG. 5 is a reverse side view, showing the seam that secures the sleeve holder together.

Referring to FIGS. 2 & 3, the sleeve holder 6 is shown removed from the forearm 7 and sleeve 8 in its at-rest condition defining a closed conical shape. Referring to FIG. 5, it is an opposite side (reverse side) view, showing the seam 22 that secures the sleeve holder together. The fabric and elastic core may be constructed at various lengths to accommodate forearms 7 of different sizes. It should also be noted that the seam 22 may be sewn to the inside of the cover 13 so that the seam lays flat. Or, the seam may be sewn with end portion 17 lying atop end portion 16 so that the seam lays flat.

FIG. 1 shows only one sleeve 8 in a gathered-up condition to facilitate the description of an embodiment of the present invention. However, it should be understood that a pair of sleeve holders 6 would typically be used by a person to secure both sleeves 8 of the garment they are wearing, in a gathered-up condition.

Figure 6:
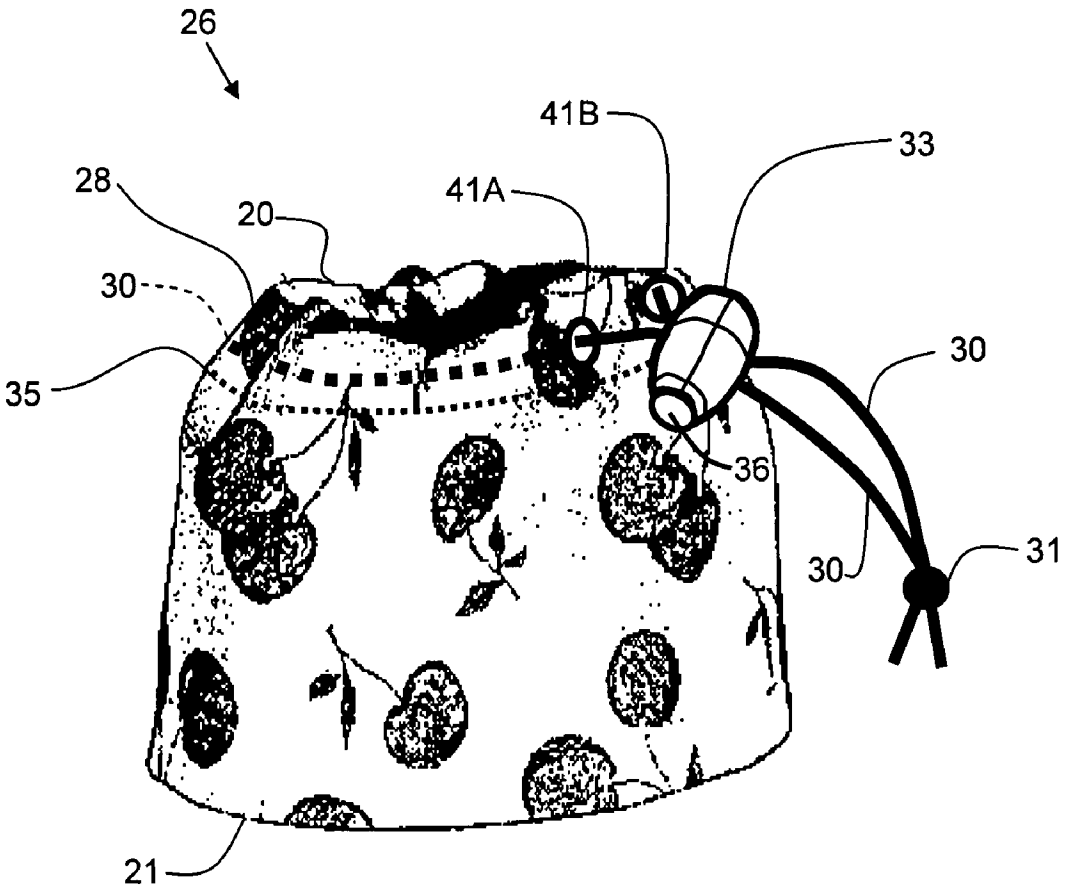
FIG. 6 is a side view of an alternative embodiment of a sleeve holder.
Figure 7:
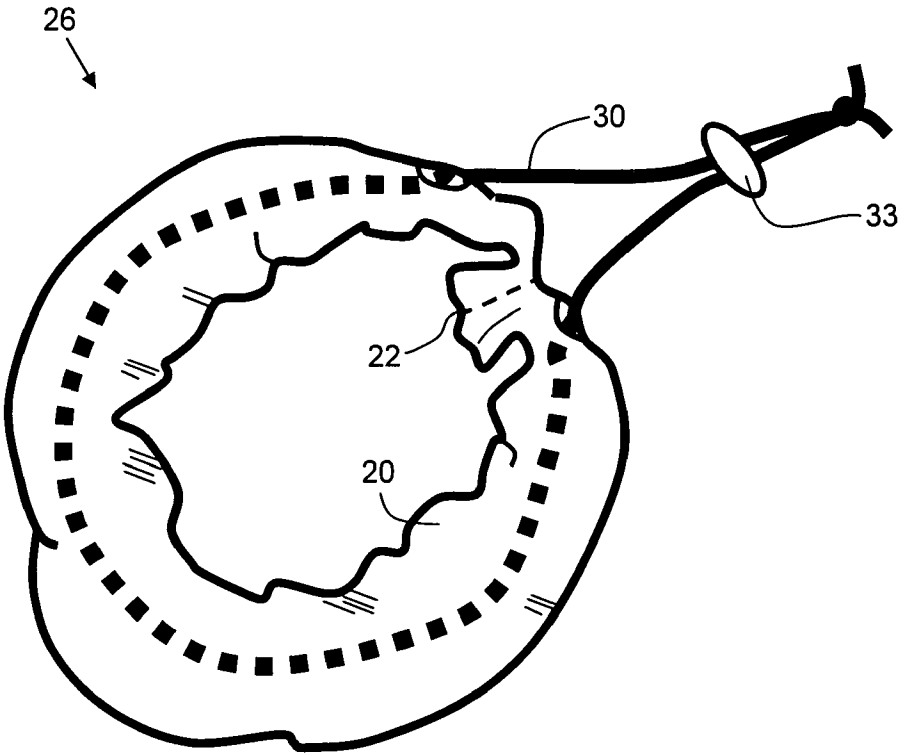
FIG. 7 is a top-down view of the sleeve holder of FIG. 6

FIGS. 6 and 7 show an alternative embodiment of a sleeve holder. FIG. 6 is a side view of an alternative embodiment of sleeve holder 26. In this embodiment, a conduit 28 is formed by forming a seam 35 near to narrow end 20 of sleeve holder 26. A cord 30 is threaded through conduit 28 via grommets 41A and 41B, and is secured via cord lock 33. While the embodiment shown uses grommets, another embodiment (not shown) only has access holes, eliminating the grommets. In one embodiment, cord lock 33 comprises a spring-loaded release mechanism, activated by release button 36. Such cord locks are known in the art, and are the subject of U.S. Pat. Nos. 4,288,891 and 6,189,186, both of which are incorporated herein by reference. The cord ends may be joined by fastener 31, or knotted together, to keep the cord 30 orderly. FIG. 7 is a top-down view of the sleeve holder 26 of FIG. 6. In this view, the cord 30 is shown oriented around the circumference of the sleeve holder 26. The cord 30 is preferably comprised of elastic, or other flexible, stretchable material. Cord 30 eliminates the need for core 18 of the embodiment shown in FIG. 4.

When using sleeve holder 26, the user first places the sleeve holder 26 on the arm, preferably between the wrist and the elbow, with the narrow end 20 oriented towards the wrist. The user then adjusts cord lock 33 to provide a comfortable amount of tension on the wearer's arm, such that the sleeve holder 26 is tight enough to remain securely in place, but not so tight as to be uncomfortable to wear. In this way, the sleeves of a sleeved-garment are protected during activities such as gardening, dishwashing, and food preparation, to name a few.

Although the description above contains many specific details, these should not be construed as limiting the scope of the invention, but merely as providing illustrations of some of the presently preferred embodiments of the present invention.

What is claimed is:

1. A device for protecting a sleeve of a garment on a wearer's forearm comprising:

a body of material formed in the shape of a truncated cone comprising a wide end and a narrow end wherein both ends are open;

a conduit formed by a seam near the narrow end of the truncated cone;

an elastic cord having two cord ends, the cord located within the conduit wherein each cord end protrudes out of the conduit via two access holes spaced apart and wherein the wide end of the truncated cone has a circumference greater than the elastic cord thereby forming a pocket where the sleeve of the garment is held;

a cord lock for securing the two ends of the elastic cord; and a spring loaded release mechanism having closely spaced openings for the cord which bias the conduit to a V-shape between the access holes to hide the seam and providing a means for releasably locking and adjusting the cord ends.

2. The device of claim 1, wherein each access hole comprises a grommet.

3. The device of claim 1 wherein the body of material is comprised of cotton.

4. The device of claim 1, wherein the body of material is comprised of polyester.

5. The device of claim 1, wherein the body of material is comprised of nylon.

6. The device of claim 1, wherein the body of the material is comprised of latex rubber.

7. The device of claim 1, wherein the body of material is comprised of leather.

8. The device of claim 1, further comprising a waterproof coating disposed on the body of material.

* * * * *